US012540434B2

(12) United States Patent
Leandersson et al.

(10) Patent No.: US 12,540,434 B2
(45) Date of Patent: Feb. 3, 2026

(54) SUPPORT BODY AND PAPER MACHINE COMPRISING SUCH A SUPPORT BODY

(71) Applicant: VALMET AB, Sundsvall (SE)

(72) Inventors: Anders Leandersson, Karlstad (SE); Jonas Berg, Hammarö (SE); Anders Brattström, Karlstad (SE); Peter Järkeborn, Karlstad (SE); Adam Nordin, Karlstad (SE)

(73) Assignee: VALMET AB, Sundsvall (SE)

( * ) Notice: Subject to any disclaimer, the term of this patent is extended or adjusted under 35 U.S.C. 154(b) by 281 days.

(21) Appl. No.: 18/253,450

(22) PCT Filed: Nov. 17, 2021

(86) PCT No.: PCT/EP2021/081974

§ 371 (c)(1),
(2) Date: May 18, 2023

(87) PCT Pub. No.: WO2022/122327

PCT Pub. Date: Jun. 16, 2022

(65) Prior Publication Data

US 2024/0044078 A1 Feb. 8, 2024

(30) Foreign Application Priority Data

Dec. 7, 2020 (SE) ..... 2051421-2

(51) Int. Cl.
*D21F 3/04* (2006.01)
*D21F 3/02* (2006.01)

(52) U.S. Cl.
CPC ..... *D21F 3/04* (2013.01); *D21F 3/0209* (2013.01)

(58) Field of Classification Search
CPC ..... D21F 3/04; D21F 3/0209
(Continued)

(56) References Cited

U.S. PATENT DOCUMENTS 5,011,578 A * 4/1991 Lange ..... D21F 3/0245 100/153
5,951,824 A 9/1999 Deshpande
(Continued)

FOREIGN PATENT DOCUMENTS

DE 3030233 A1 2/1982
DE 202013009470 U1 1/2014
(Continued)

OTHER PUBLICATIONS

International Search Report and Written Opinion for International Application No. PCT/EP2021/081974, dated Mar. 1, 2022, (11 pages), European Patent Office, Rijswijk, Netherlands.
(Continued)

*Primary Examiner* — Jacob T Minskey
(74) *Attorney, Agent, or Firm* — Alston & Bird LLP

(57) ABSTRACT

The present invention relates to a support body (50) for a paper machine having an extended nip formed between the support body and a counter-pressure member, wherein the support body comprises—a base body (51) comprising an upper surface facing in the first direction, —a cover body (52) comprising a working surface (15) for forming an extended nip with a counter-pressure member, wherein the cover body (52) is mounted on the upper surface of the base body (51) such that the working surface faces in the first direction, and wherein the cover body (52) comprises a first material, said first material being a polymer. The invention also relates to a paper machine comprising a support body (50).

19 Claims, 5 Drawing Sheets

Figure 1:
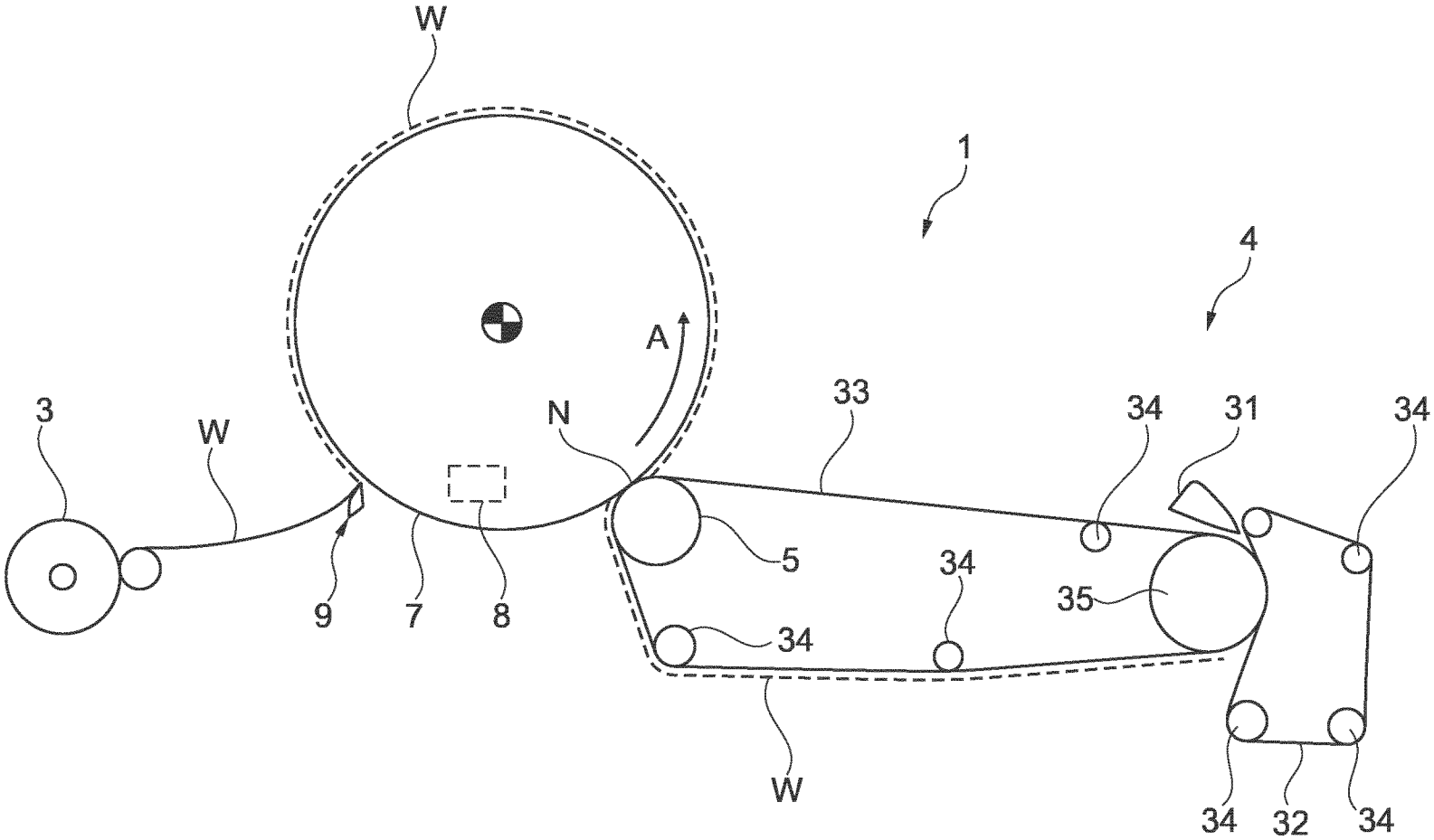

(58) Field of Classification Search
USPC ..... 162/358.3
See application file for complete search history.

(56) References Cited

U.S. PATENT DOCUMENTS

| | | | | |
|---|---|---|---|---|
| 2009/0173465 | A1 | 7/2009 | Gustavsson | |
| 2015/0060000 | A1* | 3/2015 | Gustavsson | D21F 3/0218 162/358.3 |

FOREIGN PATENT DOCUMENTS

| | | | |
|---|---|---|---|
| JP | H1143887 | A | 2/1999 |
| WO | WO-2005/038129 | A1 | 4/2005 |
| WO | WO-2013/015739 | A1 | 1/2013 |
| WO | WO-2015/171043 | A1 | 11/2015 |

OTHER PUBLICATIONS

Japanese Office Action for Japanese Application No. 2023-534367, dated May 28, 2024, 10 pages.

* cited by examiner

SUPPORT BODY AND PAPER MACHINE COMPRISING SUCH A SUPPORT BODY

CROSS REFERENCE TO RELATED APPLICATIONS

This application is a National Stage Application, filed under 35 U.S.C. § 371, of International Application No. PCT/EP2021/081974, filed Nov. 17, 2021, which international application claims priority to and the benefit of Swedish Application No. 2051421-2, filed Dec. 7, 2020; the contents of both of which as are hereby incorporated by reference in their respective entireties.

TECHNICAL FIELD

The present invention relates to a support body for an apparatus having an extended nip formed between the support body and a counter-pressure member. Such an apparatus is typically a paper machine in which the extended nip is used for dewatering a web.

BACKGROUND

In a paper making machine, an extended nip press is generally used for pressing water out of a newly formed wet fibrous web but an extended nip may also be used for other purposes, e.g. calendering. Although extended nip presses were first introduced for heavy grades such as paperboard, they have also come to be used for lighter grades such as printing paper and even for tissue paper. When making tissue paper, the extended nip press is often formed by an extended nip roll and a Yankee drying cylinder that acts as a counter roll for the extended nip roll.

An extended nip press, especially in a machine for making tissue paper, is typically formed by an extended nip roll that comprises a support body with a working surface that is pressed against the counter roll by pressurized chambers inside or below the support body acting to push the support body in a first direction towards the counter roll. The purpose of the extended nip press is to dewater a fibrous web during production of paper.

Within the art, rigid support bodies typically made from metallic materials are known but since they are inflexible it is difficult to achieve a desired pressure profile in the extended nip and this prevents an efficient dewatering of the fibrous web as well as causing excessive wear on components of the extended press nip such as the extended nip roll and the felt used to transport the web through the nip.

It is also known to use softer, more flexible support bodies that are elastically deformable in order to adjust the extended nip and overcome the known drawbacks connected with rigid support bodies. However, flexible support bodies are less robust and have a shorter lifespan than rigid support bodies.

Both rigid support bodies and flexible support bodies thus suffer from drawbacks. There is therefore a need for improvements within this area.

SUMMARY

The object of the present invention is to eliminate or at least to minimize the problems discussed above. This is achieved by a support body and a paper machine comprising such a support body according to the appended independent claims.

The support body according to the present invention is suitable for an apparatus having an extended nip formed between the support body and a counter-pressure member, and the support body comprises

- a base body comprising an upper surface facing in a first direction, and
- a cover body comprising a working surface for forming an extended nip with a counter-pressure member, wherein the cover body is mounted on the upper surface of the base body such that the working surface faces in the first direction.

The cover body comprises a first material that is a polymer.

By providing the support body with a base body and a cover body mounted thereon and by the cover body being a polymer, the support body is able to have advantages of a known elastically deformable support body while at the same time being able to be fitted into paper machines where previously non-flexible support bodies such as metal bodies have been used. Since the cover body comprises a polymer, wear on adjacent components is kept to a minimum but at the same time the support body has an increased stability due to the base body.

Suitably, the first material has a shore D hardness of 60 or less. Thereby, the first material is rendered soft and flexible enough to be able to function as a flexible support body and form the elongated nip with the same advantages as commonly associated with flexible support bodies. At the same time, the first material is hard and durable enough to be able to be pressed into the elongated nip with high precision.

Also, the first material may suitably have a shore A hardness of 50-100, preferably a shore A hardness of 80-100 and more preferably a shore A hardness of 90-95. This means that the first material is soft and flexible so that the advantages associated with flexible support bodies are achieved and so that damage to surrounding components due to pressing the support body into the nip may be avoided or at least minimized. It is also advantageous to replace a metal support body previously used in a paper machine with a support body according to the invention having a first material with a hardness in the ranges disclosed here since this allows for the advantages of the flexible support body without requiring substantial rebuilding of a support and displacement devices in the paper machine.

The first material may suitably be polyurethane that is especially suited to flexible support bodies yet may be designed to have properties that are suitable for a given application.

Alternatively, the first material may be an elastomer such as rubber. This has the advantage of providing an elastic and highly flexible support body.

Suitably, the base body comprises a metal such as steel or aluminium. Thereby, the base body is rendered inflexible and is able to support the cover body in an advantageous manner. Other suitable materials for the base body include metal alloys such as bronze.

Alternatively, the base body comprises a polymer that is harder than the first material. This means that the polymer of the base body has a shore A hardness or a shore D hardness that is higher than the values given above for the first material. Providing a harder polymer in the base body has the advantage of achieving a support for the cover body while at the same time using an inexpensive material. Advantageously, the base body may comprise a reinforced polymer such as a carbon fiber reinforced polymer or a glass fiber reinforced polymer.

In some embodiments, the cover body comprises an upper body portion that comprises the working surface and the cover body also comprises a lower body portion, said upper body portion being fixed to the lower body portion.

Thereby, the cover body may be made in layers or portions with different properties, and the lower body portion may also comprise a holder or other type of fastening device in order to facilitate mounting the cover body on the base body. This is suitable in rendering manufacture easier, and by providing layers or portions of different properties the pressure profile of the elongated nip press may also be designed to suit a desired pressure profile.

The lower body portion may comprise at least one of a polymer, a metallic material, or a reinforced polymer. Thereby an increased stiffness of the lower body portion may be achieved, giving a stable bottom for the upper body portion of the cover body.

Suitably, the cover body is fixedly attached to the base body by an adhesive arranged between the cover body and the base body. Thereby, the support body may be made in an easy and reliable way achieving a suitable holding of the cover body on the base body.

Alternatively, the cover body is fixedly attached to the base body by molding. Thereby an even more efficient fixing of the cover body to the base body is achieved, efficiently preventing the cover body from coming loose during handling, transport, mounting and use.

In another alternative, the base body comprises a holder configured to be attached to the base body and to the cover body. Thereby a reliable fastening of the cover body is also achieved, without requiring the use of more complex techniques such as molding. This also enables the mounting of the cover body on the base body to take place in various locations such as on site near or in a paper machine. By manufacturing the base body and the cover body separately from each other and joining them together by using the holder, a simplified manufacture of the support body is thus achieved.

Suitably, the base body is also connectable to a displacement device for displacing the support body in the first direction. Thereby, the support body may be pressed against a counter roll to form the elongated nip.

The present invention also comprises a paper machine comprising a support body according to the invention.

Many additional benefits and advantages of the present invention will be readily understood by the skilled person in view of the detailed description below.

DRAWINGS

Figure 2:
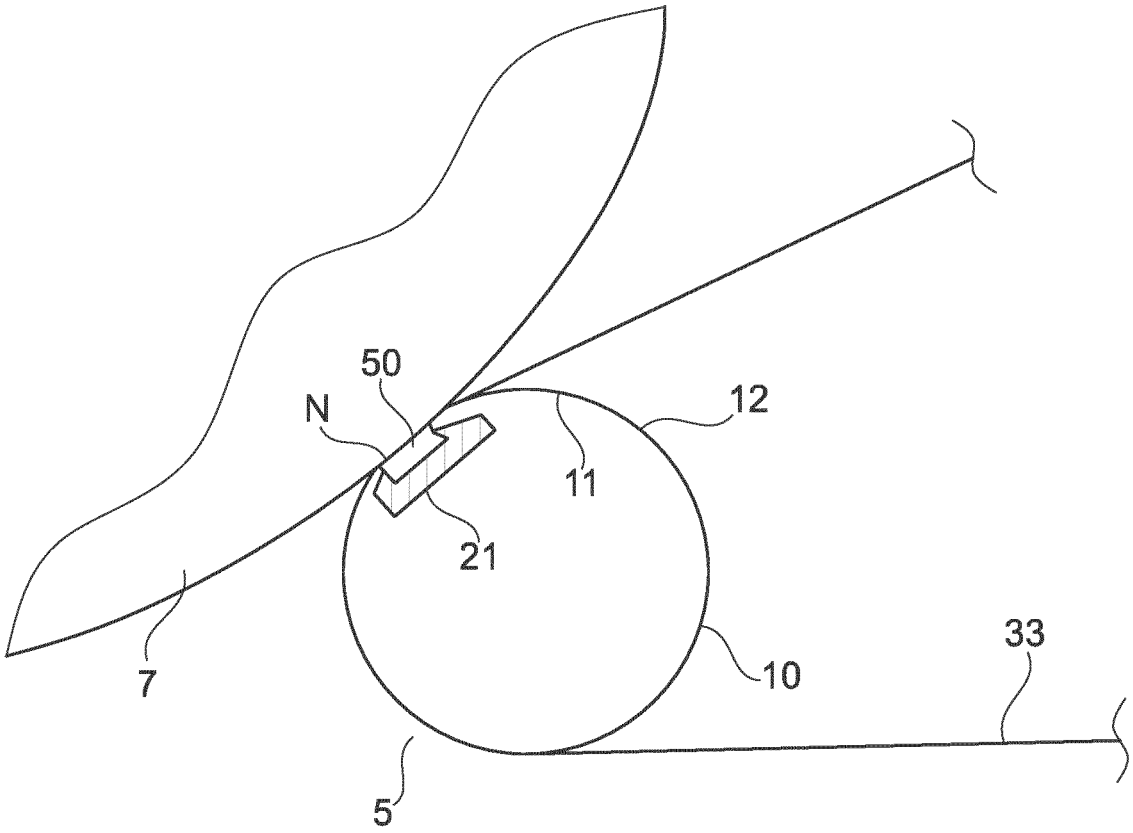
Figure 3:
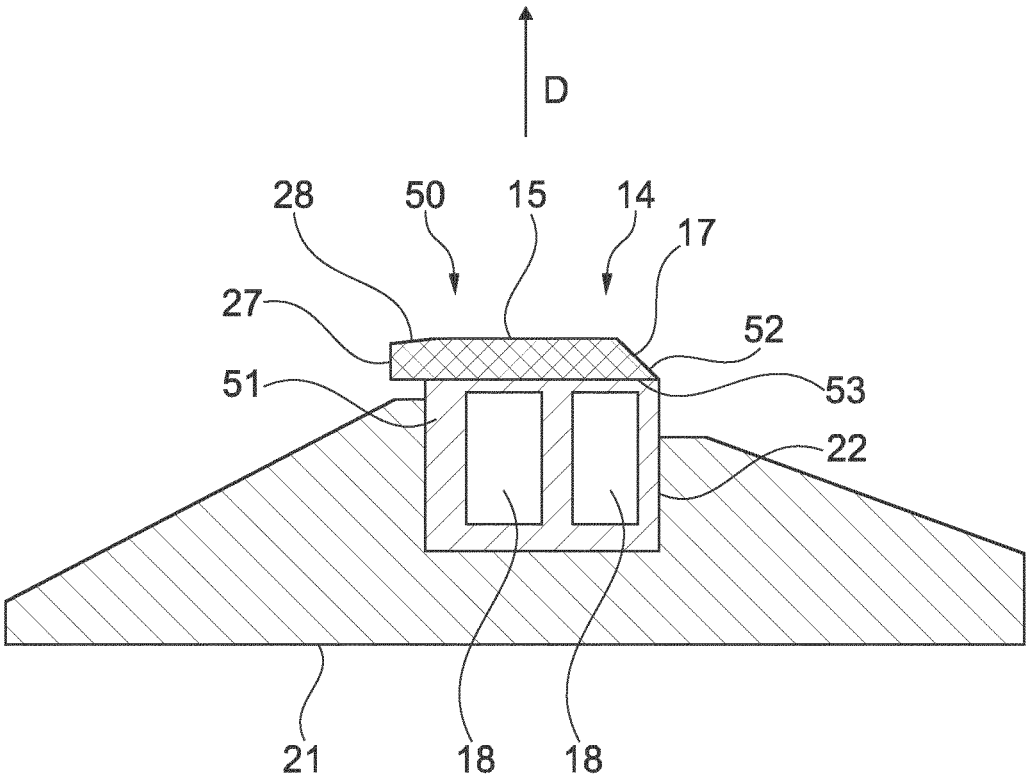
Figure 4:
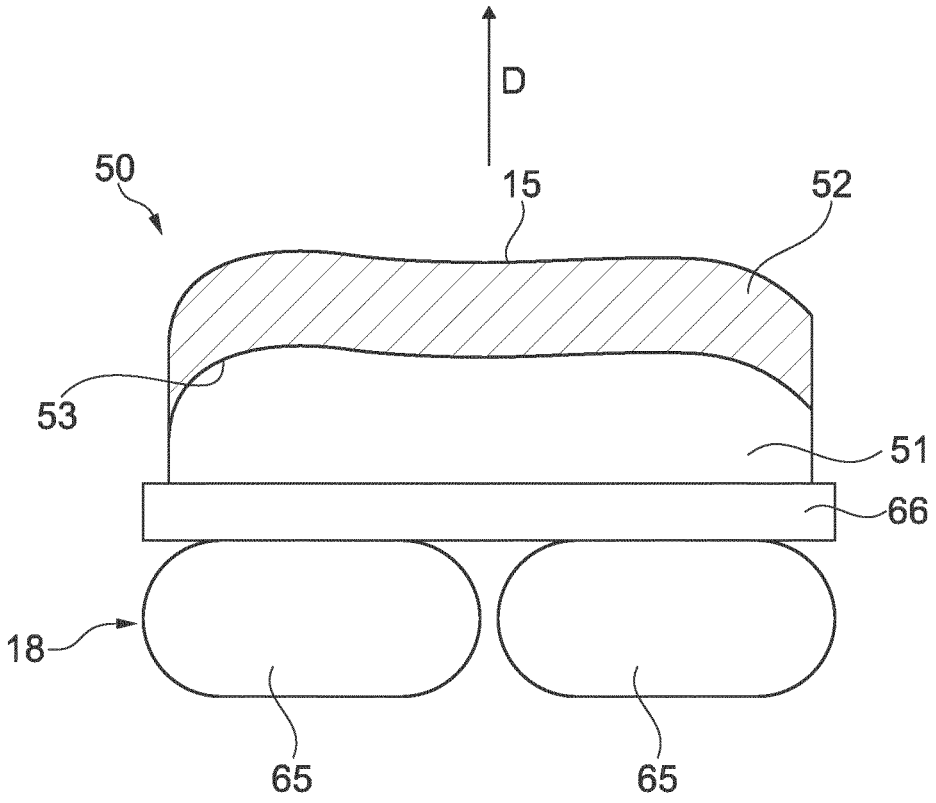

The invention will now be described in more detail with reference to the appended drawings, wherein FIG. 1 discloses schematically a paper machine comprising a support body according to the present invention;

FIG. 2 discloses a schematic cross-sectional view of an extended nip press of the paper machine of FIG. 1, in which the extended nip is formed between a support body and a counter-pressure member;

FIG. 3 discloses a cross-sectional view of the support body according to the invention placed in a support;

FIG. 4 discloses a first embodiment of the present invention; and

Figure 5:
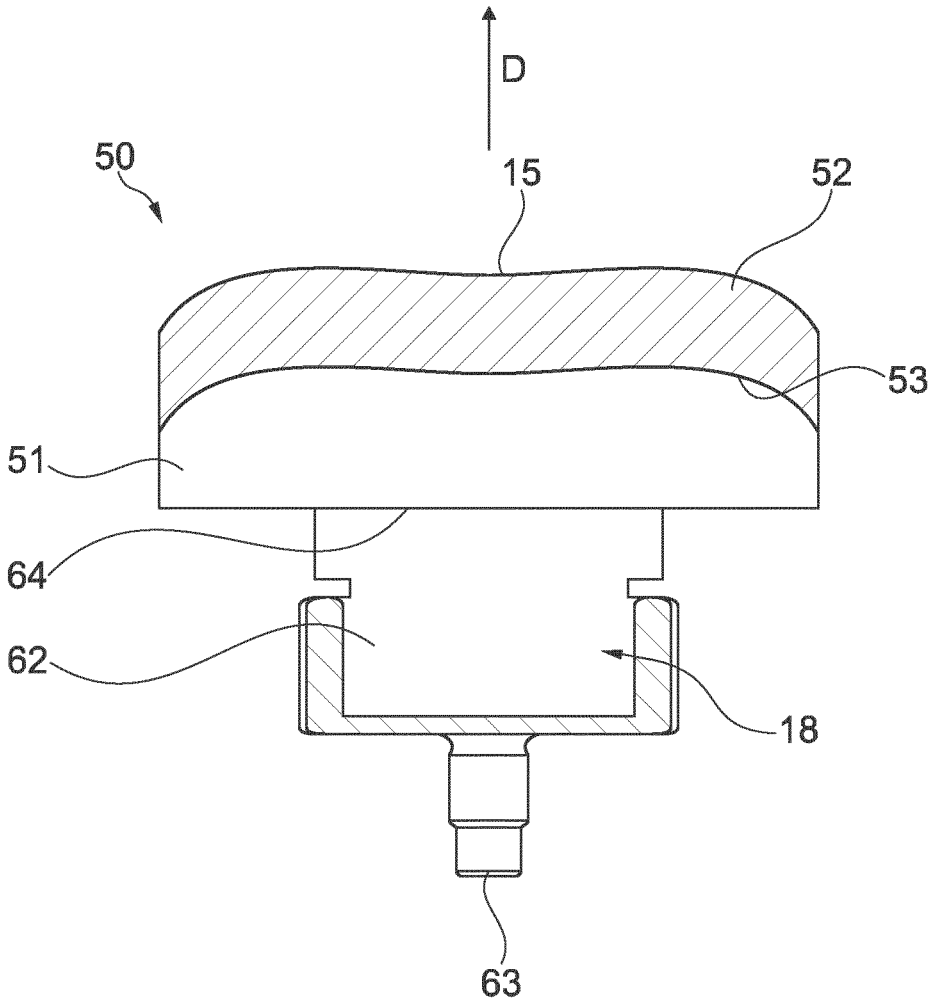

FIG. 5 discloses a second embodiment of the invention.

All the figures are schematic, not necessarily to scale, and generally only show parts which are necessary in order to elucidate the respective embodiments, whereas other parts may be omitted or merely suggested. Any reference number appearing in multiple drawings refers to the same object or feature throughout the drawings, unless otherwise indicated.

DETAILED DESCRIPTION

When referring to a "paper machine" herein, this is to be understood as a machine suitable for producing paper from a pulp. The machine may be configured to produce tissue paper but may alternatively be configured to produce writing paper or paperboard. In the following, references are made to the production of tissue paper but this is to be seen as an example only and not as limiting to the scope of the present invention.

When terms such as "upper", "lower", "top" and "bottom" are used in the following this is to be understood as being in relation to a first direction D that may be seen as a direction upwards. Thus, an upper side is a side that faces in the first direction D whereas a lower side faces in a direction opposite to the first direction D. Also, an upper part and a bottom part differ from each other in a movement towards the first direction D first passing the bottom part before passing the upper part.

FIG. 1 discloses schematically a paper machine 1 with a forming section 4 in which a head box 31 is arranged to inject stock in a gap between a forming fabric 32 and a felt 33. The forming fabric 32 would typically be a foraminous wire. The felt 33 is configured to pass over a forming roll 35 and the felt 33 and the forming fabric 32 are guided in loops by guide rolls 34. From the forming section 4, a newly formed wet fibrous web W is transported by the felt 33 to an extended press nip N formed between an extended nip roll 5 and a counter-pressure member 7. The extended nip roll 5 comprises a support body according to the present invention as will be described in more detail further below. The counter-pressure member 7 may suitably be a Yankee drying cylinder but in some embodiments the extended nip may be arranged between the extended nip roll 5 and another counter-pressure member 7 before being passed to a Yankee drying cylinder.

In the press nip N between the extended nip roll and the counter-pressure member 7, water is pressed out of the web W and absorbed by the felt 33 which is water-receiving. The web W then passes over the Yankee drying cylinder 7 and is dried by heat propagated from the Yankee drying cylinder 7 to the web W. The Yankee drying cylinder 7 comprises internal heating symbolically identified as a heating device 8 but it is to be noted that various ways of heating a Yankee drying cylinder 7 are known, such as from within the Yankee drying cylinder or from an outside, and that each of the known ways of heating would be suitable for use with the paper machine 1 described herein. Suffice it to say that the Yankee drying cylinder 7 is typically heated to reach a temperature on a surface that contacts the web W of about 95-100° C. A dry solids content of the web W as it reaches the extended press nip N may vary considerably but is in typical applications in a range 18-30%. After the extended press nip N, the web W may have a dry solids content of 40-55%, depending on factors such as linear load in the nip, the temperature of the counter-pressure member 7 and the dry solids content of the web W before it reaches the extended press nip N.

The web W is typically doctored from the Yankee drying cylinder 7 by a doctor blade 9 and is passed in the form of a ready-dried web W to a reel-up 3.

What is said above is to be regarded as a general description of a paper machine 1, but it is especially to be noted that the support body arrangement according to the present invention may be used with various kinds of paper machines as long as they have the extended press nip between a support body and a counter-pressure member.

FIG. 2 discloses the extended press nip N formed between the extended nip roll and the counter-pressure member 7 in more detail, showing the extended nip roll 5 to comprise a flexible jacket 10 with an interior surface 11 and an exterior surface 12. The flexible jacket 10 typically comprises polyurethane and is shaped as a tube that extends in a cross machine direction, said cross machine direction being a direction that is perpendicular to a machine direction defined as a direction from the forming section 4 to the reel-up 3, i.e. a main direction of travel of the web W.

Thus, the flexible jacket 10 has an axial direction that coincides with the cross machine direction and at its axial ends the flexible jacket 10 is normally connected to end walls that are rotatably arranged about and axis so that the extended nip roll 5 is able to rotate. Suitably, the extended nip roll 5 may be connected to a source of pressurized air so that an enclosed space formed by the flexible jacket 10 and the end walls may be filled with pressurized air.

Inside the extended nip roll 5, a support 21 is mounted and holds the support body 50 according to the present invention such that an upper surface 14 of the support body 50 is pressed against the interior surface 11 of the flexible jacket 10. On the upper surface 14 is a working surface 15 (see FIG. 3 onwards) that forms the extended press nip N by being pressed against the flexible jacket 10 so that the web W is in turn pressed against the counter-pressure member 7. The support body 50 is elongated and extends along the interior surface 11 of the extended nip roll 5 in a direction transversal to a direction of rotation of the extended nip roll 5 in order to be able to press against an entire width of the web W in the extended press nip N. For this purpose, the support body 50 may have a length that is equal to or larger than an intended width of the web W, but in some embodiments the support body arrangement may instead have a length that is shorter than the intended width of the web W.

The working surface 15 is a surface that acts to form the extended press nip N. The shape of the working surface 15 may be adapted to form a desired press profile with the counter-pressure member 7, as is well known within the art. One prior art technology that deals with the design of a working surface is US 2009/0173465 (Metso paper).

FIG. 3 discloses the support 21 with the support body 50 according to the present invention held in place in a groove 22 in a view from a cross machine direction. The support body 50 comprises a base body 51 and a cover body 52 that in some embodiments are joined together by a holder 53. The base body 51 is operatively connected to at least one displacement device 18. In this Figure, the displacement device 18 is shown as an expansion device 18 configured to allow controlled expanding in a first direction D. The expansion device is shown as at least one pressure chamber 18 that is sealed and configured to be connected to a pressure source such that a supply of a pressurized fluid to the at least one pressure chamber 18 causes a controlled expansion of the at least one pressure chamber 18, leading to a controlled expanding of the base body 51 itself in the first direction D. The pressurized fluid may suitably be hydraulic fluid but in some embodiments other fluids may instead be used. In some embodiments, displacement of the base body 51 is achieved in other ways than using internal pressure chamber(s) 18 as will be described in more detail with reference to FIG. 4-5. For support bodies that have a stiff base 51, it is advantageous to use external displacement devices 18 as shown in FIG. 4-5.

Suitably, the support 21 may be configured to cover the base body 51 on every side except on a side facing in the first direction D in order to ensure that the controlled expansion is directed in the first direction D only, but alternatively the base body 51 itself may be made such that expansion of the base body 51 in other directions are not possible. Since the cover body 52 is mounted to extend from the base body 51 in the first direction D, a displacement or expansion of the base body 51 will result in the cover body 52 being pushed in the first direction D and when the support body 50 is in place inside the extended nip roll 5 this results in the cover body 52 being pressed against the interior surface 11 of the flexible jacket 10 so that the extended press nip N is formed. When the extended nip roll 5 is used, the extended press nip N is to be seen as being a closed nip when the working surface 15 of the support body is pressed against the flexible jacket 10, i.e. when the at least one pressure chamber 18 is pressurized so that the base body 51 is expanded in the first direction D. When the base body 51 is not expanded, the extended press nip N is instead to be seen as being open.

In an extended press nip, a pressure profile should be unsymmetrical in such a way that a pressure peak is achieved shortly before an end of the press nip and so that pressure is significantly reduced immediately after the pressure peak. Such a pressure profile reduces re-wetting of the paper web W. It is also desirable that a pressure gradient at a beginning of the nip is relatively small such that the pressure is increased gently but with a larger gradient thereafter until the peak is reached towards the end of the press nip. Depending on properties of each application where an extended press nip is used, the upper surface 14 of the cover body 52 may be adjusted to modify the pressure profile of the nip. In FIG. 3, an embodiment of the present invention is shown having the working surface 15 with an entry surface 28 and an exit surface 17 formed at either end of the working surface 15. When in use, a web W entering the extended nip is then subjected to pressure from the entry surface 18 first, followed by a middle part of the working surface 15 and ending with pressure from the exit surface 17. This achieves the desired pressure profile for the extended nip as described above. In the embodiment shown in FIG. 3, the entry surface 28 is provided on a lip 27 that extends from the cover body 52. By adjusting the working surface 15 and especially its entry surface 28 and exit surface 17, the pressure profile may be adjusted. It is especially to be noted that the working surface 15 as shown in FIG. 3 is to be seen as an example only and that it is provided herein to illustrate the purpose of providing a working surface 15 to the extended nip press N. The main features of the present invention, however, lies in the support body 50 as such and the use of the flexible cover body 52 in order to achieve the advantages of a flexible support body while still being able to provide a stable base body 51 that increases durability of the support body 50.

The support body 50 of the invention will now be described in more detail with reference to FIGS. 4-5.

As stated above, the support body 50 comprises a base body 51 and a cover body 52 that are joined or attached to each other to form the support body 50 itself. The cover body 52 comprises a first material that is a polymer, giving the advantage of a flexible working surface 15 that may be pressed into the extended press nip N and achieve the desired pressure profile. The first material suitably has a shore D hardness of 60 or less, or alternatively the first material has a shore A hardness of 50-100, preferably a shore A hardness of 80-100 and more preferably a shore A hardness of 90-95. When referring to a shore A hardness or shore D hardness herein, this is to be understood as according to ASTM D2240.

Suitable materials to use as the first material include polymers such as polyurethane that has an advantage in being able to be designed to achieve a desired hardness for use as the cover body 52. Although a shore A hardness of 90-95 is highly desirable in view of the resulting properties of the support body 50 that allow for use in forming an elongated nip and achieve a desirable profile for the nip, harder and softer materials are also suitable within the intervals given above. Also, polyurethane is advantageous due to its high durability. One particularly suitable type of polymers for achieving a softer and more flexible cover body are elastomers, such as rubber for instance. When using rubber or a similar elastomer, the cover body is rendered elastically deformable in a desirable way so that the desired pressure profile is achieved. Other suitable polymers may also be used. The cover body 52 may also comprise a plurality of materials as long as the cover body 52 as a whole is elastically deformable.

The base body 51 is suitably not flexible or easily deformable but serves instead to provide a stable base for the cover body 52. For this purpose, the base body 51 comprises a second material that is preferably a metal such as steel or aluminium, or a metal alloy such as bronze. In some embodiments, the second material could instead be another sufficiently stiff material such as reinforced polymer, e.g. carbon fiber reinforced polymer or glass fiber reinforced polymer (fiberglass). The base body 51 may also comprise a plurality of materials as long as the base body 51 as a whole is able to provide support for the cover body.

One particularly suitable combination is for the base body 51 to comprise steel and the cover body 52 to comprise polyurethane. This is advantageous in providing stability and durability while at the same time providing the flexible working surface 15 that is able to achieve the desired pressure profile in the extended press nip. Another suitable combination is for the base body 51 to comprise aluminium or bronze and the cover body 52 to comprise polyurethane. In yet another suitable combination, the base body 51 comprises a reinforced polymer and the cover body 52 comprises an elastomer such as rubber. This is also advantageous in providing a stable base and a flexible working surface.

FIG. 4 discloses a first embodiment of the support body 50 of the present invention, having the base body 51 with the cover body 52 mounted thereon. In the first embodiment a holder 53 is provided for mounting the cover body 52. The holder is configured to engage with the cover body 52 and the base body 51 so that the cover body 52 is fixed to the base body 51. Examples of such holders are male/female holders, threaded holders, protrusion/groove holders and interlocking holders. Alternatively, the holder 53 may instead comprise an adhesive that is applied to at least one of the base body 51 and the cover body 52, or alternatively the cover body 52 may be molded onto the base body 51. When adhesive or molding is used, the holder 53 is in the form of a join 53.

In the first embodiment of FIG. 4, the cover body 52 is molded onto the base body 51 and this is achieved by manufacturing the base body 51 and then placing the base body 51 in connection with a mold into which material intended to form the cover body 52 is inserted. By thus joining the base body 51 and the cover body 52 reliably to each other, the cover body 52 is very securely attached and a risk of the support body 50 being divided into the base body 51 and the cover body 52 is efficiently minimized.

The cover body 52 comprises the working surface 15 as previously described, and the base body 51 is configured to be connected to the displacement device 18 that in this first embodiment is in the form of at least one but preferably two or even more hoses 65 that extend along the support body 50 on a lower side of the base body 51 and that are preferably connected to the base body 51 by a plate 66. By supplying a pressurized medium to the at least one hose 65, the hose(s) is/are expanded so that the plate 66 is pushed in the first direction, thereby also pushing the support body 50 itself in the first direction. This expansion device 18 is particularly suitable in embodiments where the base body 51 is made from a very hard material so that expanding the base body 51 using pressure chambers is difficult. One such material is steel.

In some embodiments, the displacement device 18 may instead comprise pressure chambers that are formed in an interior of the base body 51 and are connected to a source of pressurized fluid such that a supply of pressurized fluid into the pressure chambers 61 causes the pressure chambers 61 to expand, thereby expanding also the base body 51 in order to displace the cover body 52 and an upper part of the base body 51. Using internal pressure chambers 61 in this way is especially suitable in embodiments where the base body 51 comprises a material that is able to expand, such as polymers for instance.

FIG. 5 discloses the second embodiment with the base body 51 and the cover body 52 that are fixed to each other at a join 53 that in this embodiment is created by applying an adhesive to an upper surface of the base body 51 and/or to a lower surface of the cover body 52 and bringing the base body 51 and the cover body 52 together such that the adhesive is able to act on them in order to fixate them in relation to each other. Similar to the first embodiment, this creates a firm fixation of the cover body 52 on the base body 51, but it also allows for easy manufacturing since molding and introducing holders into the base body 51 and/or cover body 52 may be avoided.

The displacement device 18 is in this embodiment in the form of a hydraulic cylinder 62 that is configured to be supplied with a hydraulic fluid through an inlet 63 and that contacts the base body 51 at a contact surface 64. The supply of hydraulic fluid in this embodiment results in the support body 50 being pushed in the first direction D. This expansion device 18 is also advantageous where it is not desirable to include chambers inside the base body 51, and the hydraulic cylinder 62 is also suitable in being able to provide very large forces with high precision for displacing the support body 50 in the first direction.

In some embodiments, the cover body comprises an upper body portion and a lower body portion, with the upper body portion being fixed to the lower body portion. The upper body portion then comprises the working surface 15. This use of two portions to form the cover body 52 is advantageous in facilitating the use of a plurality of materials for the cover body 52, such as the elastically deformable first material in the upper body portion and a more sturdy material such as a metal or metal alloy, or a carbon fiber material or a polymer material for the lower body portion. The lower body portion may in such embodiments be attached to the upper body portion during manufacture of the cover body 52 or may be alternatively be attached in connection with the cover body 52 being fixed to the base body 51.

It is to be noted that features from the various embodiments described herein may freely be combined, unless it is explicitly stated that such a combination would be unsuitable.

The invention claimed is:

1. A support body (50) for a paper machine having an extended nip formed between the support body and a counter-pressure member, wherein the support body (50) comprises:

a base body (51) comprising an upper surface facing in a first direction (D), and a cover body (52) comprising a working surface (15) for forming an extended nip with a counter-pressure member, wherein:

the cover body (52) is mounted on the upper surface of the base body (51) such that the working surface (15) faces in the first direction (D), the cover body (52) comprises a first material, said first material being a polymer, and the cover body (52) comprises an entry surface (28) that extends upstream of the working surface (15) and to at least a leading edge of the base body (51).

2. The support body of claim 1, wherein the first material has a shore D hardness of 60 or less.

3. The support body of claim 1, wherein the first material has a shore A hardness of 50-100.

4. The support body of claim 1, wherein the first material has a shore A hardness of 80-100.

5. The support body of claim 1, wherein the first material has a shore A hardness of 90-95.

6. The support body of claim 1, wherein the first material is polyurethane.

7. The support body of claim 1, wherein the first material is an elastomer.

8. The support body of claim 7, wherein the elastomer is rubber.

9. The support body of claim 1, wherein the base body (51) comprises a metal.

10. The support body of claim 9, wherein the metal is steel or aluminum.

11. The support body of claim 1, wherein the base body (51) comprises a polymer that is harder than the first material.

12. The support body of claim 11, wherein the base body (51) comprises a reinforced polymer.

13. The support body of claim 12, wherein the reinforced polymer is a carbon fiber reinforced polymer or a glass fiber reinforced polymer.

14. The support body of claim 1, wherein the cover body (52) comprises an upper body portion that comprises the working surface and the cover body also comprises a lower body portion, said upper body portion being fixed to the lower body portion.

15. The support body of claim 14, wherein said lower body portion comprises at least one of a polymeric material, a metallic material, or a reinforced polymer.

16. The support body of claim 1, wherein the cover body (52) is fixedly attached to the base body (51) by an adhesive arranged between the cover body (52) and the base body (51).

17. The support body of claim 1, wherein the cover body (52) is fixedly attached to the base body (51) by molding.

18. The support body of claim 1, further comprising a holder (53) configured to be attached to the base body (52) and to the cover body (52) for mounting the cover body (52) on the base body (51).

19. The support body of claim 1, wherein further the base body (51) is connectable to a displacement device for displacing the support body in the first direction.

* * * * *